United States Patent [19]

Silverman

[11] 4,358,356

[45] Nov. 9, 1982

[54] METHOD FOR SLOPING INSULATIVE LAYER IN BUBBLE MEMORY

[75] Inventor: Peter J. Silverman, Palo Alto, Calif.

[73] Assignee: Intel Magnetics, Inc., Santa Clara, Calif.

[21] Appl. No.: 252,798

[22] Filed: Apr. 13, 1981

[51] Int. Cl.[3] ..... C23F 1/02

[52] U.S. Cl. ..... 204/192 E; 156/643

[58] Field of Search ..... 204/192 E; 156/643

[56] References Cited

U.S. PATENT DOCUMENTS

| | | | |
|---|---|---|---|
| 4,016,062 | 5/1977 | Mehta et al. | 204/192 E |
| 4,172,758 | 10/1979 | Bailey et al. | 204/192 E |
| 4,229,248 | 10/1980 | Silverman et al. | 156/643 |
| 4,248,688 | 2/1981 | Gartner et al. | 204/192 E |

OTHER PUBLICATIONS

Ion Implantation, Sputtering and Their Applications, P. D. Townsend et al., Academic Press, 1976, pp. 111–112.

*Primary Examiner*—Veronica O'Keefe

*Attorney, Agent, or Firm*—Blakely, Sokoloff, Taylor & Zafman

[57] ABSTRACT

A process is described for removing the rounded regions in a silicon dioxide layer particularly in a layer covering conductive members. The silicon dioxide layer is subjected to ion milling. The angle of incidence of the ions striking the rounded regions is greater than the angle of incidence in other regions of the layer. This causes more of the rounded regions to be removed, thereby providing a smoother, faceted surface. The process eliminates the need to taper the edges of the conductive members as done in the prior art.

10 Claims, 6 Drawing Figures

METHOD FOR SLOPING INSULATIVE LAYER IN BUBBLE MEMORY

BACKGROUND OF THE INVENTION

1. Field of the Invention

The invention relates to the field of magnetic bubble devices and particularly the formation of magnetic members on an insulative layer in bubble memories.

2. In the fabrication of magnetic bubble memories, permalloy members are formed on an insulative layer. Often a silicon dioxide layer is formed over conductive members and then the permalloy members are formed on the silicon dioxide layer. When the silicon dioxide layer is formed over the conductive members, rounded regions occur in the silicon dioxide layer along the edges of the underlying conductive members. When the permalloy members are formed over these rounded regions, they include somewhat vertical sections, which as will be described in conjunction with FIGS. 1 and 3, are undesirable.

In the prior art to prevent the formation of the rounded regions in the insulative layer, the edges of the underlying conductive members are tapered. A well-known acid etching process is used to obtain this taper. When the insulative layer is formed over these conductive members, it is generally smoother in the region of the edges of the conductive members. The permalloy members formed on this insulative layer are flatter.

Typically, with this prior art etching process a taper of approximately ½ micron (measured in the horizontal direction) is obtained along the edges of the conductive members. Where conductive members are approximately 4 microns wide, this prior art process works well. However, where narrower members are used (e.g., two microns) too much of the conductive material is lost in the taper. This, of course, degrades the electrical performance of the conductive members.

As will be seen, the present invention provides a process for removing the rounded regions in the insulative layer (without tapering the sides of the underlying conductive members).

SUMMARY OF THE INVENTION

The invented process is particularly useful in the fabrication of magnetic bubble memories where an insulative layer is formed over a conductive member. During the formation of the insulative layer, rounded regions occur in the layer along the edges of the conductive member, unless the conductive member is tapered. The present invention prepares the insulative layer for the permalloy members by removing these rounded regions. In the presently preferred embodiment, the insulative layer formed over the conductive member is made thicker than its ultimate thickness in the memory. Then the insulative layer is subjected to ion milling. The angle of incidence of the ions is approximately zero degrees with respect to the planar surfaces of the layer; this angle is substantially larger than zero degrees (e.g., 45 degrees) with respect to the rounded regions occurring in the insulative layer. The rounded regions are milled to a greater extent than the planar surfaces because of the larger angle of incidence, thereby causing the rounded regions to become smoother.

DETAILED DESCRIPTION OF THE INVENTION

A process is described for smoothing rounded regions in an insulative layer, particularly for bubble memories. In the following description, numerous specific details are set forth such as specific thicknesses, in order to provide a thorough understanding of the present invention. It will be obvious to one skilled in the art, however, that these specific details need not be followed in order to practice the present invention. In other instances, well-known processing steps and structure have not been described in detail in order not to obscure the present invention in unnecessary detail.

In general, the present invention is employed during the fabrication of a magnetic bubble memory. The memory is fabricated on a garnet substrate, specifically a gadolinum gallium garnet ($Gd_3Ga_5O_{12}$). An ion implanted magnetic garnet epitaxial layer is formed on the substrate and acts as the magnetic storage layer. Aluminum alloy conductive members are fabricated on a silicon dioxide layer which is formed over the storage layer. The members are typically associated with the input/output portion of the memory. Permalloy patterns are then formed on a second silicon dioxide layer which covers the conductive members. In some instances the permalloy members are formed on the second insulative layer directly over the conductive members. A permanent magnetic field for biasing the magnetic layer and an inplane, rotating magnetic field are employed, as is well-known.

Figure 1:
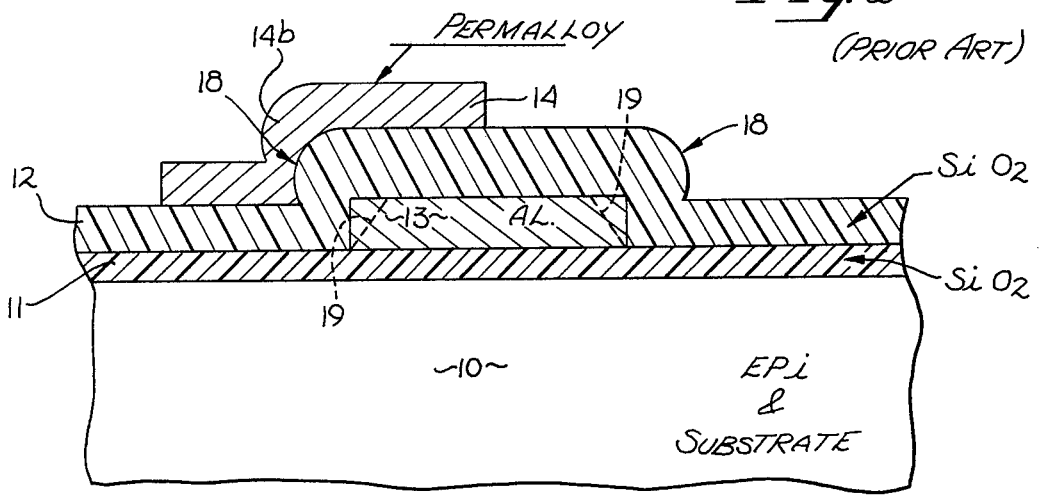
Fig. 1 (PRIOR ART)
FIG. 1 is a cross-sectional elevation view of a portion of a magnetic bubble memory used to illustrate the prior art problem solved by the present invention.

Referring first to FIG. 1, a substrate and epitaxial layer 10 covered with a silicon dioxide layer 11 are illustrated. A conductive member such as aluminum member 13, is shown formed on the layer 11. A second silicon dioxide layer 12 is formed over the conductive member 13 and layer 11. Where the conductive member 13 has substantially vertical edges, rounded regions 18 occur in the silicon dioxide layer 12. When a permalloy member 14 is formed on the layer 18, it includes a vertical section **14*b***.

Figure 2:
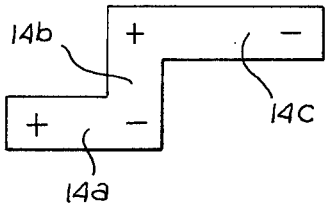
Fig. 2 (PRIOR ART)
FIG. 2 is a cross-sectional representation of the permalloy member shown in FIG. 1.

Referring to FIG. 2, the permalloy member 14 of FIG. 1, because of the vertical section **14*b* acts as two separate magnetic members 14*a* and 14*c***. Moreover, since the vertical section is thinner, the coupling between the horizontal sections is poor. This reduces the effectiveness of this permalloy member.

The problem described above has been well recognized in the prior art, and to solve it, the edges of the conductive member 13 are tapered as indicated by tapered edges 19. When this taper is employed, the rounded regions 18 of layer 12 do not occur and the permalloy member 14 is substantially flatter. Where the conductive member 13 is narrow, a substantial portion of the conductive member is lost during tapering. This, of course, increases the resistance of the conductive member and deteriorates the performance of the memory.

Figure 3:
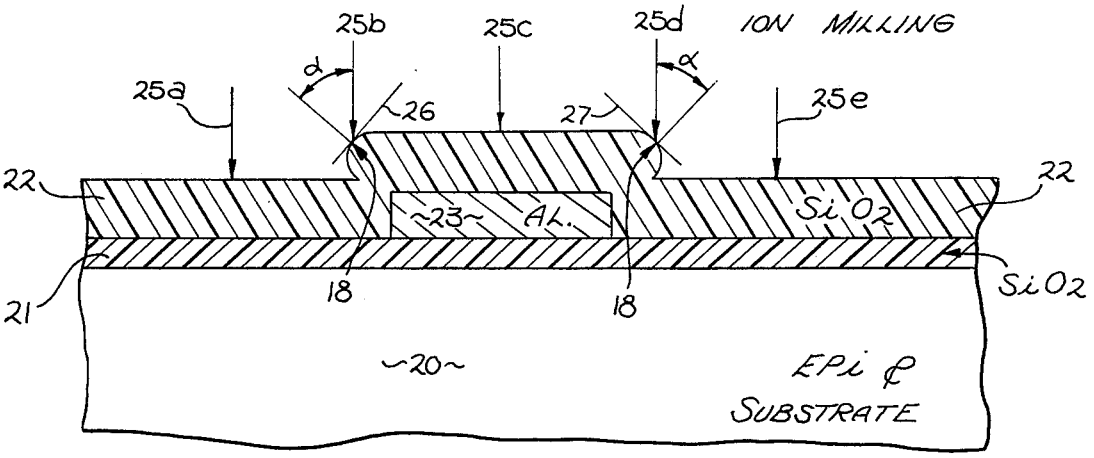
FIG. 3 is a cross-sectional elevation view of a portion of a magnetic bubble memory which includes a conductive member and an overlying insulative layer.

Referring now to FIG. 3, a silicon dioxide layer 21 is shown formed over an epitaxial layer and substrate 20. The layer 21 is a sputtered silicon dioxide layer in the presently preferred embodiment. A layer of conductive material is formed over the layer 21 and patterned in a well-known manner to form conductive members such as the conductive member 23. As is illustrated in FIG. 3, in the presently preferred process, no attempt is made to taper the edges of the conductive member 23 as done in the prior art.

Now a second silicon dioxide layer 22 is sputtered over the layer 21 and the conductive member 23. The thickness of this layer as used in the memory is approximately 2000 A. With the invented process, the layer is made approximately twice as thick as is ultimately required. Thus, layer 22 of FIG. 3 is sputtered to a thickness of approximately 4000 A. As described in conjunction with FIG. 1, the rounded regions 18 occur.

Now the substrate is subjected to ion milling. In the presently preferred process, a commercially available ion milling system from VEECO is employed (10 inch Microetch). An energy level of approximately 600 ev is used with argon ions.

Referring to FIG. 3, at the planar surfaces of the layer 22, the angle of incidence between the ions and the surface 22 is approximately zero degrees. For example, for the trajectories 25*a* and 25*e*, the angle of incidence is approximately zero degrees. At the rounded regions 18 of the layer 13, the angle of incidence is substantially greater than zero degrees. For example, assume that line 26 is coplanar with a segment of the rounded edge 18; the angle of incidence with respect to this rounded segment for the trajectory 25*b* appears to be close to 45 degrees. Similarly for the trajectory 25*d* and line 27, an angle of incidence of approximately 45 degrees results. Over the central portion of the conductive member 23, the angle of incidence is approximately zero degrees as indicated for trajectory 25*c*.

Figure 6:
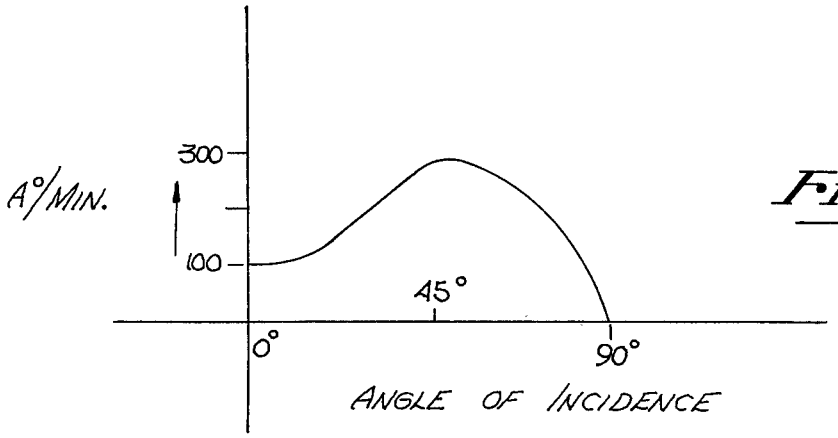
FIG. 6 is a plot of milling rate as a function of angle of incidence.

Referring briefly to FIG. 6, it is known in the prior art that the rate of ion milling is a function of the angle of incidence. For example, as illustrated in FIG. 6, milling will occur at 100 A per minute at a zero angle of incidence, and increase to approximately 300 A per minute at an angle of incidence of 45 degrees. This phenomena is put to use in the present invention.

Figure 4:
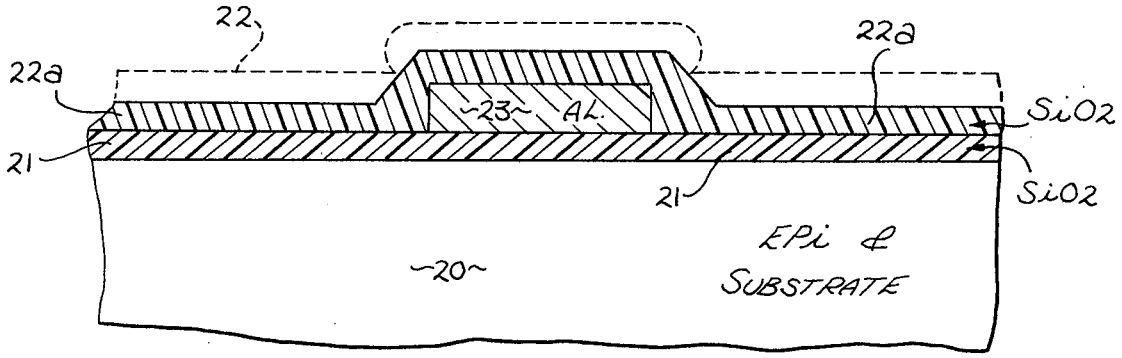
FIG. 4 illustrates the structure of FIG. 3 after ion milling.

Again, referring to FIG. 3, the angle of incidence at the rounded regions 18 is substantially greater than on the planar surfaces. These regions are thus milled at a much higher rate than the planar surfaces. In the presently preferred embodiment, the ion milling is continued until the layer 22 (in the planar regions) is reduced to half its initial thickness. The resultant layer 22*a* is shown in FIG. 4; its thickness being approximately 2000 A. The original layer 22 is shown in dotted lines in FIG. 4 for purposes of comparison. Substantially more silicon dioxide is milled along the edges of the conductive member 23 thus smoothing the insulative layer as shown in FIG. 4.

Figure 5:
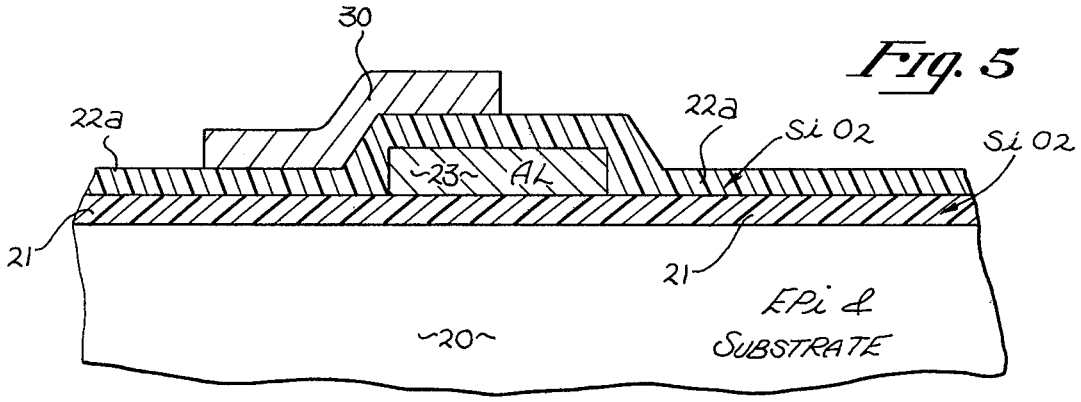
FIG. 5 illustrates the structure of FIG. 4 after the formation of a permalloy member on the insulative layer.

Now referring to FIG. 5, a permalloy member 30 may be formed directly over the layer 22*a*. As is illustrated, the member 30 is substantially flatter than the member 14 of FIG. 1.

The above described process has the advantage of allowing the conductive member to be narrower for a given resistance since its edges need not be tapered. This is particularly important for high density applications.

Thus, a process has been employed which uses ion milling for faceting rounded regions in a silicon dioxide layer. Unlike the prior art, the underlying conductive members need not be tapered. This permits smaller conductive members to be used.

I claim:

1. In the fabrication of a magnetic bubble memory where an insulative layer is formed over a conductive member, and wherein during the formation of said insulative layer rounded regions occur in said layer along the edges of said conductive member, a process for preparing said layer for permalloy members, comprising the steps of:

forming said insulative layer over said conductive member to a thickness which is thicker than its ultimate thickness in said memory; and, subjecting said insulative layer to ion milling such that the angle of incidence of the ions is approximately zero degrees with respect to the planar surface of said layer and such that the angle of incidence of said ions is approximately 45 degrees at at least one point on said rounded regions occurring in said layer so as to mill said rounded regions to a greater extent than said planar regions;

whereby said rounded regions become flatter.

2. The process defined by claim 1 wherein said insulative layer is silicon dioxide.

3. The process defined by claim 2 wherein said ion milling employs argon ions.

4. The process defined by claim 3 wherein said desired thickness of said insulative layer is approximately one-half the initial thickness of said layer.

5. The process defined by claim 4 wherein said ultimate thickness is approximately 2000 A.

6. In the fabrication of a magnetic bubble memory, a process for forming a permalloy member which is insulated from an underlying conductive member, comprising the steps of:

forming an insulative layer over said conductive member;

subjecting said insulative layer to ion milling such that the angle of incidence of the ions is approximately zero degrees with respect to the planar surfaces of said layer and such that the angle of incidence of said ions is approximately 45 degrees at at least one point on the rounded regions occurring in said layer so as to mill said rounded regions to a greater extent than said planar regions; and forming said permalloy member on said insulative layer;

whereby said permalloy member at said rounded regions is generally flatter because of said ion milling, thereby increasing said magnetic member's magnetic characteristics in said memory.

7. The process defined by claim 6 wherein said insulative layer comprises silicon dioxide.

8. The process defined by claim 7 wherein said ion milling uses argon ions.

9. The process defined by claim 8 wherein said insulative layer is reduced in thickness by approximately one-half during said ion milling.

10. The process defined by claim 9 wherein the angle of incidence of said ions is approximately zero degrees at said planar surface.

* * * * *